US005784722A

United States Patent [19]

Ureta et al.

[11] Patent Number: 5,784,722

[45] Date of Patent: Jul. 28, 1998

[54] SHOWER BACK SCRUBBER

[76] Inventors: Luis A. Ureta, 4871 Wiota St., Los Angeles, Calif. 90041; Virgo V. Ballares, 5071 Cartagena Cir., La Palma, Calif. 90623

[21] Appl. No.: 720,664

[22] Filed: Oct. 2, 1996

[51] Int. Cl.[6] ..... A47K 7/04

[52] U.S. Cl. ..... 2/244.1; 2/244.4; 4/606

[58] Field of Search ..... 15/244.1, 244.4, 15/210.1, 97.1, 104.92; 4/606; 401/13; 428/34.1; 2/97.1, 210.1, 244.1, 244.4

[56] References Cited

U.S. PATENT DOCUMENTS

| | | | |
|---|---|---|---|
| 2,886,839 | 5/1959 | Leopoldi . | |
| 2,904,038 | 9/1959 | Hackney | 15/244.1 |
| 2,964,770 | 12/1960 | Lerner et al. | 15/244.1 |
| 3,444,579 | 5/1969 | Thomford | 15/210.1 |
| 3,542,411 | 11/1970 | Filas . | |
| 3,601,493 | 8/1971 | Levy . | |
| 3,677,951 | 7/1972 | Alles . | |
| 3,750,226 | 8/1973 | Morgan | 15/244.1 |
| 4,020,519 | 5/1977 | Robison | 15/244.1 |
| 4,047,259 | 9/1977 | Lotis . | |
| 4,704,759 | 11/1987 | Mesa . | |
| 4,872,237 | 10/1989 | Smith | 15/210.1 |
| 5,277,389 | 1/1994 | Ballares et al. . | |
| 5,450,647 | 9/1995 | Dorsey | 15/97.1 |
| 5,490,302 | 2/1996 | Dion | 15/210.1 |
| 5,500,049 | 3/1996 | Kolinsky | 15/244.1 |
| 5,600,864 | 2/1997 | Huber | 15/224.1 |
| 5,628,083 | 5/1997 | Hayes | 15/244.1 |

*Primary Examiner*—Jeanette E. Chapman
*Attorney, Agent, or Firm*—David Weiss

[57] ABSTRACT

A back scrubber for removable installation in a shower, a preferred embodiment of which includes a housing having a rear wall and a plurality of side wall segments peripherally of the rear wall, each of the side wall segments having an inwardly disposed lip therealong. A sponge is releasably held by the housing and has a thickness greater than the depth of the side wall segments for being retained along the sponge's thickness by the lips along the side wall segments.

5 Claims, 2 Drawing Sheets

SHOWER BACK SCRUBBER

BACKGROUND OF THE INVENTION

This invention relates to back scrubbers and more particularly to a back scrubber device which may be removably secured to the wall of a shower.

The present invention is an improvement of the no-hands shower back scrubber taught in U.S. Pat. No. 5,277,389, issued Jan. 11, 1994 to Virgo V. Ballares and Luis A. Ureta, the inventors herein, which patent is incorporated herein by reference. The device disclosed in our aforementioned patent includes a plastic housing having a wall with a plurality of suction cups on one side thereof for removably securing the housing to a shower wall. The other side of the housing's wall includes thereon a plurality of hooks for holding a sponge on such other side within a perimeter rim of the housing. The sponge has two scrubber surfaces, one of which is relatively rough compared to the other, and each surface is capable of releasably retaining the sponge on the hooks such that the sponge may be reversed or replaced on the housing wall without removing the housing from the shower wall when the housing is secured to the shower wall by the suction cups with the sponge held on the housing, a person in the shower may contact and move his or her back against and about the sponge's exposed scrubbing surface.

SUMMARY OF THE INVENTION

The present invention provides a shower back scrubber with an improved housing for more securely holding a sponge while at the same time enhancing the facility with which the sponge may be installed and removed for replacement or reversibility. Briefly described, the shower back scrubber of the present invention comprises the combination of a housing including a rear wall and a side wall peripherally of the rear wall, the side wall having an inwardly disposed lip therealong; a plurality of suction cups secured to the housing's rear wall for releasably securing the housing to a shower wall; and a sponge releasably held by the housing, the sponge having a thickness greater than the depth of the side wall and retained along the sponge thickness by the lip along the side wall. In a preferred embodiment of the shower back scrubber, the side wall is segmented to comprise a plurality of side wall segments peripherally of the rear wall, each of the side wall segments having an inwardly disposed lip therealong, the thickness of the sponge being greater than the depth of the side wall segments and the sponge being retained by the housing along the sponge thickness by the lips along the side wall segments. The housing is preferably constructed of a plastic material, and the housing is substantially rigid with the side wall segments being resilient for biasing the lips against the sponge.

In the preferred embodiment of the shower back scrubber, the housing's rear wall and the sponge are generally circular in configuration, and the diameter of the sponge is slightly greater than the diameter of the rear wall such that, when the sponge is held by the housing, the lips of the side wall segments are biased against the sponge along the sponge's thickness. The side wall segments are preferably slightly inclined inwardly for enhancing the biasing force of the lips against the sponge.

BRIEF DESCRIPTION OF THE DRAWING

The novel features which are believed to be characteristic of the invention, together with further advantages thereof, will be better understood from the following description considered in connection with the accompanying drawing in which preferred embodiments of the invention are illustrated by way of example. It is to be expressly understood, however, that the drawing is for the purpose of illustration and description only and is not intended as a definition of the limits of the invention.

DESCRIPTION OF THE PREFERRED EMBODIMENTS

Figure 1:
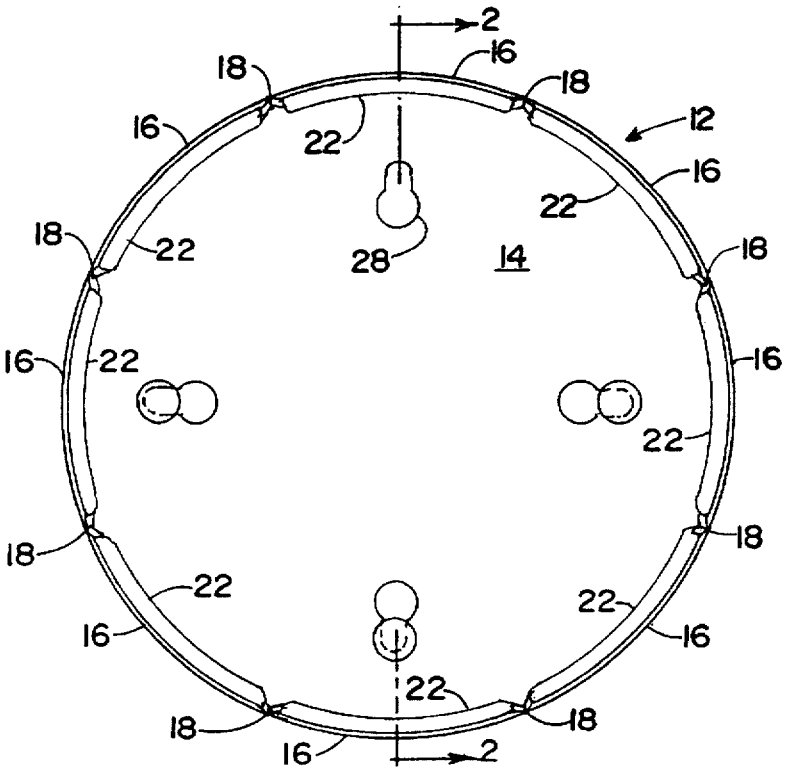
FIG. 1 is a front elevation view of a preferred embodiment of the housing of the shower back scrubber of the present invention, with three of four suction cups shown attached thereto.

Referring to FIGS. 1–4, the preferred embodiment of a shower back scrubber device 10 according to the present invention includes a generally circular housing 12 having a rear wall 14 and a side wall which is preferably segmented into a plurality of side wall segments 16. The side wall segments 16 are situated along the periphery of the rear wall 14 and are of substantially equal length, i.e. of substantially equal arcs along the circumference of the circular rear wall 14 and equally spaced therealong and separated by slits or notches 18 extending from the edge 20 of each wall segment 16 toward the rear wall 14. Each of the side wall segments 16 includes an inwardly disposed lip 22 therealong, i.e. the edge 20 of each wall segment 16 projects inwardly of its side wall segment 16 and of the perimeter of the rear wall 14.

The housing 12 is preferably constructed of any substantially rigid plastic material well known in the plastics art, and may be fabricated by conventional plastic forming processes such as by injection molding. The thickness of the side wall segments 16 and their lengths (or arcs), and the depth d' of the notches 18, are such that the side wall segments 16 are diametrically resilient, i.e. are resilient along respective diameters of the circular housing 12. In one suitable example of a plastic housing 12, the thickness of the side wall segments 16 may be approximately 1/16 inch, the diameter of the rear wall 14 approximately 8 inches, the depth d of each wall segment being approximately 1½ inches and the depth d' of each notch 18 between adjacent wall segments 16 being approximately 1 3/16 inches. In this example, eight wall segments 16 of equal length or arc (approximately 43°) are equally spaced along the periphery of the rear wall 14, with the width w of each notch 18 at the edge 20 being approximately ⅛ inch (or of approximately 2° arc). Each lip 22 is preferably approximately ¼ inch thereacross (i.e. along the inwardly disposed dimension D noted in FIG. 2), although other lip dimensions (say from ⅛ inch to ½ inch or greater) would be acceptable.

A plurality of conventional suction cups 24 are secured to the rear wall 14, such as by securing a central flanged stem 26 of each suction cup 24 to respective keyhole-shaped apertures 28 in the rear wall 14. The rear wall 14, and hence the housing 12, may be releasably secured to a shower wall 30 (FIG. 4) by forcing the housing's rear wall 14 toward the shower wall 30 with the suction cups 24 being pressed against the shower wall 30, i.e. by securing the suction cups 24 to the shower wall 30 in conventional manner.

Figure 3:
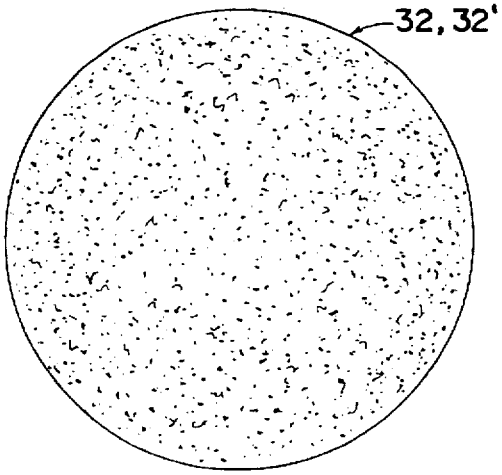
FIG. 3 is a front elevation view of a sponge for use with the cover of FIG. 1, the sponge being shown in reduced size as compared to the size of the housing as shown in FIG. 1.
Figure 4:
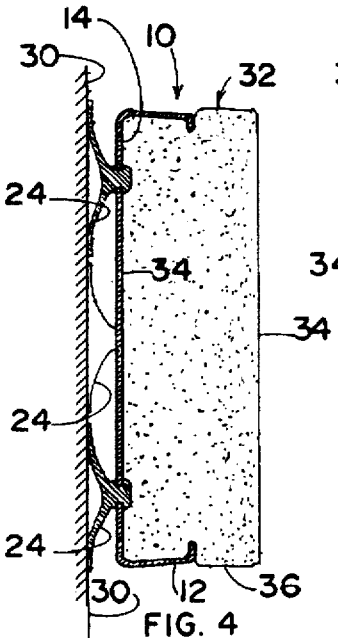
FIG. 4 is a cross-sectional side elevation view of the housing of FIG. 1 secured to a shower wall and holding one embodiment of the sponge as in FIG. 3, the cross-sectional view taken along the line 2—2 of FIG. 1 in the direction of the appended arrows but with a fourth suction cup in place.
Figure 5:
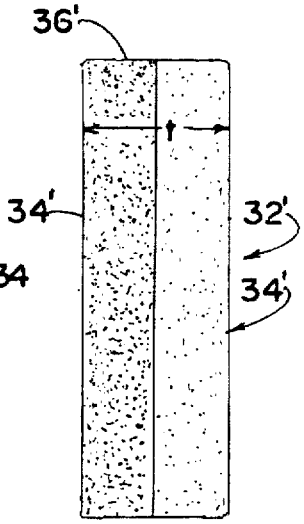
FIG. 5 is a side elevation view of another embodiment of the circular sponge as in FIG. 3.

As shown in FIGS. 3–5, the shower back scrubber device 10 includes a sponge 32 configured to be held by the housing 12 (FIG. 4). In the preferred embodiment, the sponge 32 or 32' is circular with substantially flat parallel faces 34 (FIG. 4) or 34' (FIG. 5). The sponge embodiments 32 and 32' are similar to one another except that the sponge embodiment 32' consists of two sponges of different textures adhered together such that one of the faces 34' comprises a first scrubbing surface which is relatively rough compared to the second scrubbing surface comprising the other face 34' (as disclosed in our U.S. Pat. No. 5,277,389, whereas the sponge embodiment 32 shown in FIG. 4 is substantially homogeneous throughout with both scrubbing surfaces 34 being substantially similar in texture. In either embodiment, the diameter of the sponge 32 or 32' is slightly larger (say by ½ inch) than the inside diameter of the housing 12 (i.e. the diameter of the rear wall 14 interiorly of the side wall segments 16), while the sponge's peripheral or circumferential edge 36 or 36' has a thickness t of approximately twice the depth d of the side wall segments 16. In the aforementioned example, the diameter of the housing rear wall 14 may be approximately 8 inches, the depth d of the wall segments 16 approximately 1½ inches, the inward dimension D of the lips 22 approximately ¼ inch, and the sponge 32 or 32' may have a diameter of approximately 8½ inches and a thickness t of approximately 3 inches.

In assembling the back scrubber device for use, the sponge 32 or 32' is manually pressed into the housing to the extent that one of its faces 34 contacts the housing's rear wall 14. As represented in FIG. 4, the portion of the sponge 32 situated within the housing 12 is compressed against the side wall segments 16, and in particular is compressed to a greater extent against the lips 22. The resiliency of the side wall segments 16 cause the segments 16 to act like springs such that the sponge 32 and the lips 22 are biased against each other for retaining the sponge 32 to the housing 12, and even more so when the sponge 32 expands as it becomes soaked with shower water. It may be noted that the notches 18 between the side wall segments 22 permit water to escape from the sponge 32 and the housing 12 when pressure is applied by a person's back to the sponge 32 during use.

Figure 2:
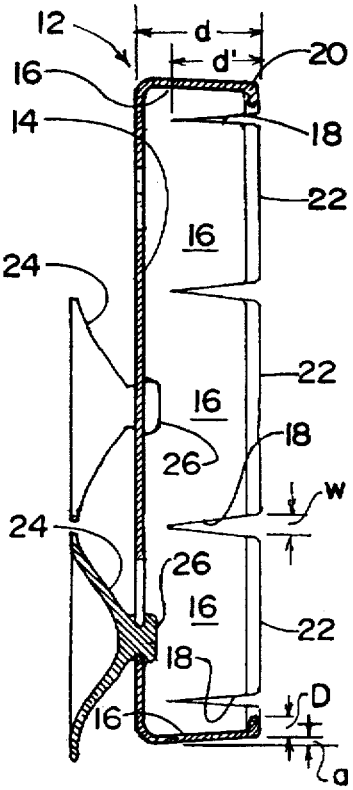
FIG. 2 is a cross-sectional side elevation view of the housing of FIG. 1, taken along the line 2—2 of FIG. 1 in the direction of the appended arrows.
Figure 6:
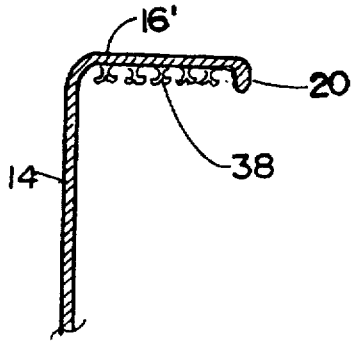
FIG. 6 is a cross-sectional side elevation view of a fragment of a variation of the housing of FIG. 2.

Although the side wall segments 16 may be substantially perpendicular to the rear wall 14, as shown by the side wall segment 16' in FIG. 6, it is preferred that the side wall segments 16 are inwardly curved or inclined as shown in FIGS. 1, 2 and 4, for enhancing the biasing effect of the lips 22 when acted upon by the sponge 32. In the aforementioned example wherein the depth d' of the notches 18 is approximately 1 3/16 inches, the side wall segments 16 may be inwardly inclined such that their edges 20 are inwardly offset from the housing's periphery by a distance a of approximately 3/32 inch or more.

Although not usually necessary, it may be desirable in some situations to enhance the retention of the sponge 32 by the housing 12, by the provision of additional means for releasably further retaining or securing the sponge 32 to the housing 12. For example, as shown in FIG. 6, the interior surface of the side wall segments may have provided thereon a plurality of hooks 38 for releasably securing the sponge 32 along its thickness to the side wall segments 16 or 16'. Such hooks 36 may be of the type shown in our aforementioned Pat. No. 5,277,389, or may be implemented by adhering to the interior surfaces of the side wall segments swatches or strips of hook type fastening material such as marketed under the trademark VELCRO.

Figure 7:
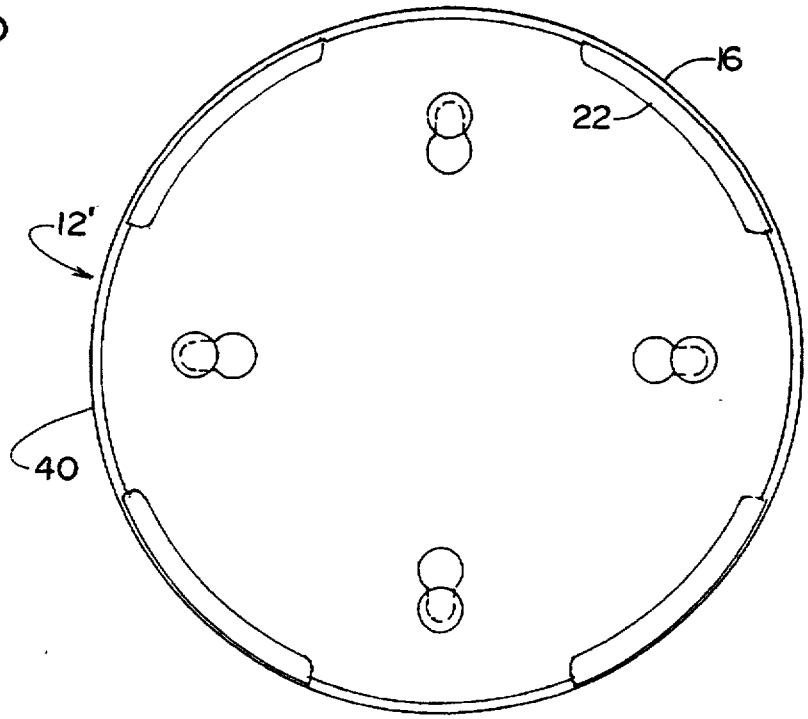
FIG. 7 is a front elevation view of an alternative embodiment of a housing according to the present invention, with four suction cups secured thereto.

In the alternative embodiment of the housing 12' shown in FIG. 7, the side wall segments 16 with their respective lips 22 are fewer in number (such as four side wall segments 16 as shown in FIG. 7), and successive side wall segments 16 are separated by a substantial distance or arc such as equal to the length or arc of each side wall segment 16. In this embodiment, the separation between successive side wall segments 16 includes a reinforcing wall 40 of shallow depth (such as ¼ inch) extending from the rear wall 14 about the periphery thereof. In the example shown in FIG. 7, each of the four side wall segments 16 may have a length of 45° arc separated by a shallow reinforcing wall 40 of 45° arc.

Figure 8:
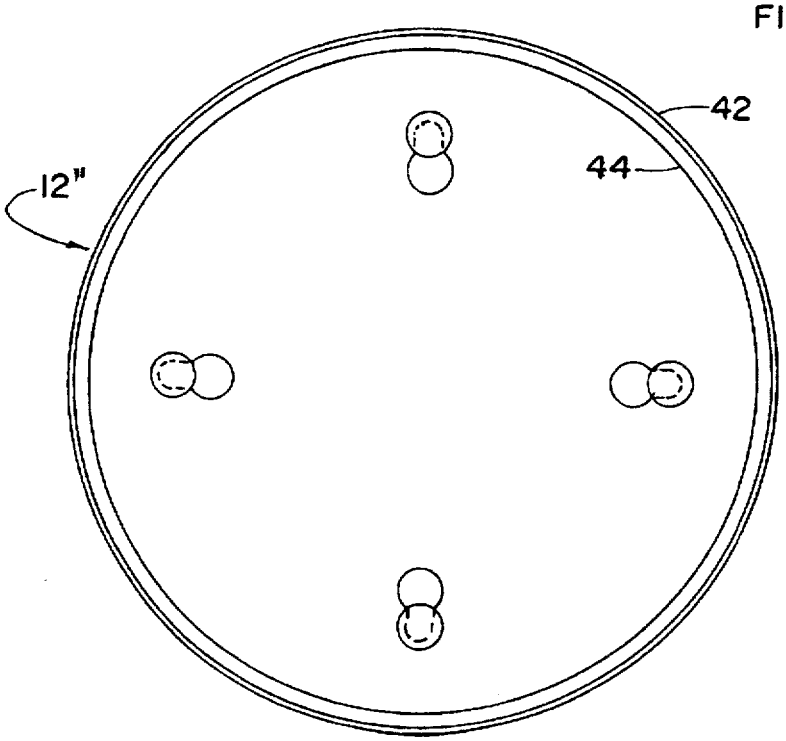
FIG. 8 is a front elevation view of another alternative embodiment of a housing according to the present invention.

In another alternative embodiment of the housing 12" shown in FIG. 8, the side wall is not segmented as in the housing preferred embodiment 12 (FIG. 1) and in the housing alternative embodiment 12' (FIG. 7). Instead, a continuous side wall 42 is situated peripherally of the rear wall 14 and has an inwardly disposed lip 44 therealong. The continuous side wall 42 and its lip 44 may be similar in cross-sectional side elevation to that of the side wall segments 16 previously described and shown in FIGS. 2 and 6. Although the non-segmented or continuous structure of the side wall 42 lacks the resiliency of the side wall segments 16, nevertheless, when assembled the portion of the sponge 32 situated within the housing 12" is compressed against the side wall 42 and in particular is compressed to a greater extent and biased against the lip 44 for retaining the sponge in the housing 12".

In use, a person attaches the back scrubber device 10 to the shower wall 30, as previously described in connection with FIG. 4, with the location and height being determined by the user in accordance with his or her preference. If desired, soap may be applied to the exposed sponge face 34. The user positions his or her body with his or her back against the sponge surface 34, and scrubs his or her back by controlling back movement and pressure upon the sponge surface 34.

The sponge 32 may be manipulated for being removed from the housing 12, and if the sponge is of a type shown in FIG. 5 with two sponge surfaces 34' of different relative roughnesses, the sponge surfaces 34' may be reversed by releasing the sponge from the housing and reinserting it with the other surface 34' facing the housing's rear wall 14. The sponge may also be removed for cleaning, or it may be replaced by a another sponge when worn or by other sponges to be used respectively by other persons using the shower.

Thus, there has been described an improved no-hands shower back scrubber. Other embodiments and configurations of the back scrubber of the present invention may be developed without departing from the essential characteristics thereof. For example, although the preferred embodiment is of circular configuration, other configurations of the housing rear wall may also be employed, such as rear walls and sponges which are oval, square, rectangular or of other configuration. Accordingly, the invention should be limited only by the scope of the claims listed below.

We claim:

1. A shower back scrubber device, comprising the combination of:

a substantially rigid housing including a rear wall and a plurality of resilient side wall segments peripherally of said rear wall, each of said side wall segments having an inwardly disposed lip therealong;

a plurality of suction cups secured to said rear wall for releasably securing said housing to a shower wall; and a sponge releasably held by said housing, said sponge having a thickness greater than the depth of said side wall segments and retained along said thickness by the lips along said side wall segments, said side wall segments biasing said lips against said sponge.

2. The shower back scrubber device according to claim 1, wherein:

said housing rear wall and said sponge are each generally circular in configuration.

3. The shower back scrubber device according to claim 2, wherein:

the diameter of said sponge is slightly greater than the diameter of said rear wall.

4. The shower back scrubber device according to claim 1, further including:

additional means for releasably further retaining said sponge to said housing.

5. The shower back scrubber device according to claim 4, wherein:

said additional means includes a plurality of hooks secured along the inside surfaces of said side wall segments.

* * * * *